United States Patent [19]

Srour

[11] Patent Number: 4,957,132

[45] Date of Patent: Sep. 18, 1990

[54] METHOD FOR LOW FREQUENCY ATTENUATION IN FLUIDIC AMPLIFICATION OF ACOUSTIC SIGNALS

[75] Inventor: Nassy Srour, Silver Spring, Md.

[73] Assignee: The United States of America as represented by the Secretary of the Army, Washington, D.C.

[21] Appl. No.: 449,206

[22] Filed: Dec. 12, 1989

[51] Int. Cl.[5] ..... F15C 1/12

[52] U.S. Cl. ..... 137/14; 137/824; 137/836

[58] Field of Search ..... 137/834, 835, 836, 822, 137/823, 824, 1, 114

[56] References Cited

U.S. PATENT DOCUMENTS

| | | | |
|---|---|---|---|
| 3,016,066 | 1/1962 | Warren | 137/835 |
| 3,623,497 | 11/1971 | Kaske | 137/824 |
| 3,732,883 | 5/1973 | Munch | 137/824 |
| 4,164,961 | 8/1979 | Drzewiecki et al. | 137/823 |
| 4,196,626 | 4/1980 | Manion et al. | 137/835 |
| 4,373,553 | 2/1983 | Drzewiecki | 137/836 |

*Primary Examiner*—A. Michael Chambers

*Attorney, Agent, or Firm*—Saul Elbaum; Paul S. Clohan

[57] ABSTRACT

A method for attenuation of low frequency acoustic sound in an acoustic detector comprising the steps of collecting incoming sound waves in the frequency range of DC to 3000 Hz so as to provide an incoming signal $S_I$, splitting the incoming signal into two signals $S_1$ and $S_2$ such that signal $S_1$ travels through a one acoustic transmission tube a distance of $L_1$ to the first control port of a fluidic laminar proportional amplifier and signal $S_2$ travels through a second acoustic transmission tube a distance of $L_2$ to the second control port of the fluidic laminar proportional amplifier, adjusting the $L_1$ distance such that the phase of input signal $S_1$ is shifted in relation to the phase of input signal $S_2$ when input signals $S_1$ and $S_2$ arrive at the control ports of the laminar proportional amplifier.

8 Claims, 3 Drawing Sheets

METHOD FOR LOW FREQUENCY ATTENUATION IN FLUIDIC AMPLIFICATION OF ACOUSTIC SIGNALS

RIGHTS OF THE GOVERNMENT

The invention described herein may be manufactured, used, and licensed by or for the United States Government for Governmental purposes without payment to me of any royalty thereon.

BACKGROUND OF THE INVENTION

The present invention relates to amplification of low frequency acoustic signals by fluidic amplifiers.

It is well known in the prior art to use a laminar proportional amplifier (LPA) to amplify low frequency acoustic signals, such as human speech. In a paper entitled "A Fluidic Audio Intercom" by T. M. Drzewiecki, 20th Anniversary of FLuidics Symposium, ASME, 1980, pages 89–94, a fluidic audio intercom suitable for use in a combat vehicle is described, in which a laminar proportional amplifier has an input connected to receive normal speech sound waves, and its outputs connected by air filled tubing to an airline head set.

When using the "C-format" LPA as an acoustic sensor, the LPA provides a flat gain of about 14 dB over a bandwidth of DC to around 800 Hz, when using a single input channel of the LPA. However, when there is an increase in the DC pressure signal, the jet passing through the nozzle of the LPA will tend to saturate the LPA and ground the signal.

When an acoustic sensor employing an LPA for sound application is used outdoors, wind becomes a significant problem. Wind, whose content mainly consists of low frequency noise, tends to provide enough signal to saturate the LPA jet into the vent region (ground). This causes the acoustic sensor to loose most of its effectiveness on windy days.

OBJECTS AND SUMMARY OF THE INVENTION

It is therefore a primary objective of the invention to provide a method for the attenuation of low frequency noise, such as wind, in acoustic sensors which employ laminar proportional amplifiers as the means for amplification of the incoming sound waves.

Another object of this invention is to improve the filtering capabilities of laminar proportional amplifiers.

A still further object of this invention is to increase the gain of laminar proportional amplifiers at selected bandwidths.

By using the method provided by the present invention, an acoustic signal can be doubled over a selected bandwidth by introducing a change in the signal path length. The result is a total gain or around 20 dB in the characteristics of the fluidic laminar proportional amplifier over a predetermined range of bandwidth, and a reduction in signal amplitude in the rest of the frequency band. The present inventive method also provides an increase in filtering capabilities by attenuating the rest of the frequency band. The present inventive method is therefore similar to a tunable bandpass filter on one hand, and a select band frequency amplifier on the other hand.

DETAILED DESCRIPTION OF THE PREFERRED EMBODIMENTS

The fluidic LPA is inherently a differential amplifier and is often used as an acoustic sensor. A differential amplifier is an amplifier that provides an output that is proportional to the difference of the input signals, i.e. if the input signals are $S_1$ and $S_2$, the output signal $S_0$ will be $S_1-S_2$. When an acoustic white noise input signal $S_I$ with an amplitude of 26 dB is fed into a single input of an LPA, the output signal $S_0$ is a coherent signal having a flat increase in gain of that same signal by 14 dB between DC and approximately 800 Hz (see curve 1, FIG. 1). If this same input signal $S_I$ is split into two signals and fed into both input ports of the LPA, the input signals will cancel each other out because the two input signals will arrive "in-phase" at the control ports of the LPA and act equally upon the supply jet. Therefore, in order to take advantage of the differential amplifier characteristics of the LPA, the input signal $S_I$ must be split into two signals, $S_1$ and $S_2$, and a phase shift between the two signals must be created so that the two signals do not cancel.

The frequencies that require attenuation in acoustic sensing devices are generally below 500 Hz. At these low frequencies, the wavelength of each discrete frequency is relatively long. For example, the wavelength of a 50 Hz signal is 259.2 inches, and the wavelength of a 300 Hz signal is 43.2 inches. For any given frequency, the wavelength $\gamma$ in inches can be determined from the following equation:

$$\gamma = c/f$$

where $c$=the speed of sound in inches per second and $f$=the frequency of the signal in Hz. "c" has a value of 12,960 in/sec at 25 degrees F., and varies according to the temperature of the air.

As stated above, if the two input signals $S_1$ and $S_2$ arrive at the control ports of the LPA "in phase" they cancel. Likewise, if the two signals arrive at the control ports 180° out of phase, the output signal $S_0$ doubles, e.g. when $S_1$ has an amplitude of 1 and $S_2$ has an amplitude of $-1$ (180° out of phase), the resultant output signal $S_0$ is:

$$S_0 = S_1 - S_2 = 1-(-1) = 2$$

Figure 3:
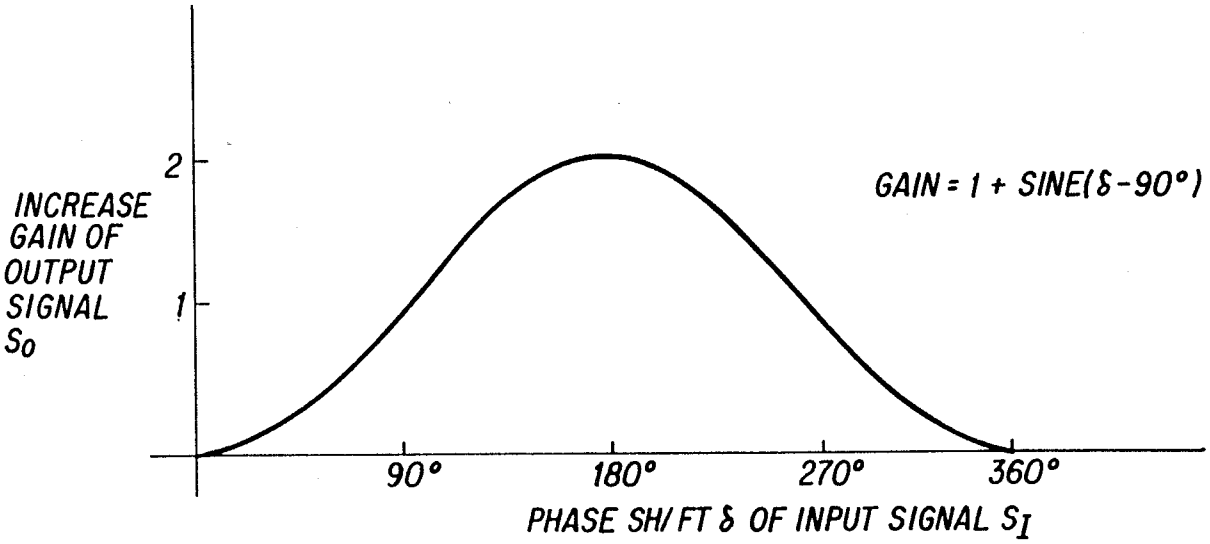
FIG. 3 is a graph of the output signal gain versus the phase shift of the input signals.

Likewise, when the two input signals $S_1$ and $S_2$ arrive at the control ports at either 90° or 270° out of phase, the gain is the same as if only one input port was used (i.e., the signal was not split). The above relationship between the phase shift of the input signals and the output signal gain is shown graphically in FIG. 3 where the curve is a sinusoidal curve translated 90° on the x axis and $+1$ on the y axis thus the increased output signal gain (over a single input LPA gain) can be described by the following equation:

$$\text{Increased Gain} = 1 + \text{Sin}\ (\delta - 90°)$$

where $\sigma$ is the phase shift in degrees between input signals $S_1$ and $S_2$.

Figure 2:
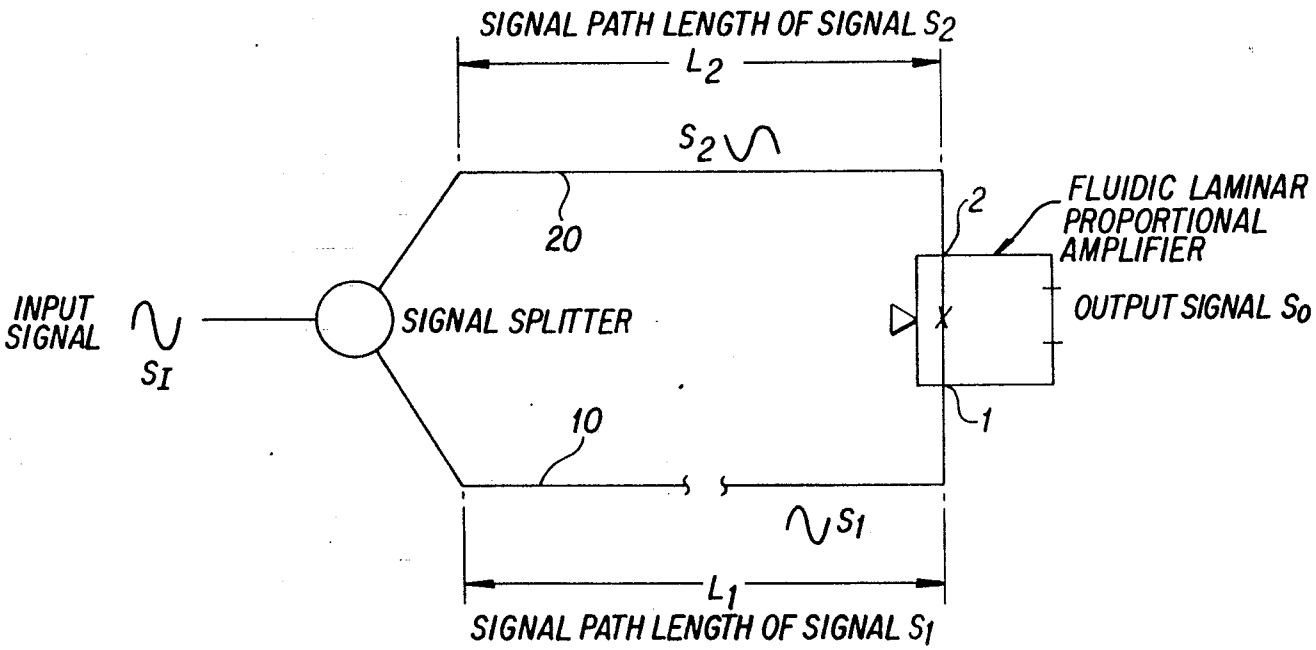
FIG. 2 is a schematic diagram of the dual input signal path to a fluidic LPA.

The method used to accomplish a phase shift between $S_1$ and $S_2$ is to provide a differnce in signal path length for input signal $S_1$ between the input signal splitter and the LPA, as shown in FIG. 2. Input signal $S_1$ travels down path 10 a distance of $L_1$ to control port port 1 and input signal $S_2$ travels down path 20 a distance of $L_2$ to control port 2. The difference in signal path lengths $L_1-L_2$ determines the coresponding phase shift between signals $S_1$ and $S_2$. For example, if the frequency of the input signal $S_I$ is 540 Hz, the wavelength $\gamma$ of input signal $S_I$ is 24 inches. In order to shift the phase of input $S_1$ by 180°, the difference in signal path lengths $L_1-L_2$ must be $\gamma/2$ or 12 inches, i.e. path length $L_1$ must be 12 inches longer or 12 inches shorter than path length $L_2$. Similarly, to shift the phase of signal $S_1$ by 90°, $L_1-L_2$ is $\gamma/4$ or 6 inches, and to shift $S_1$ by 270°, $L_1-L_2$ is $3\gamma/4$ or 18 inches.

Figure 1:
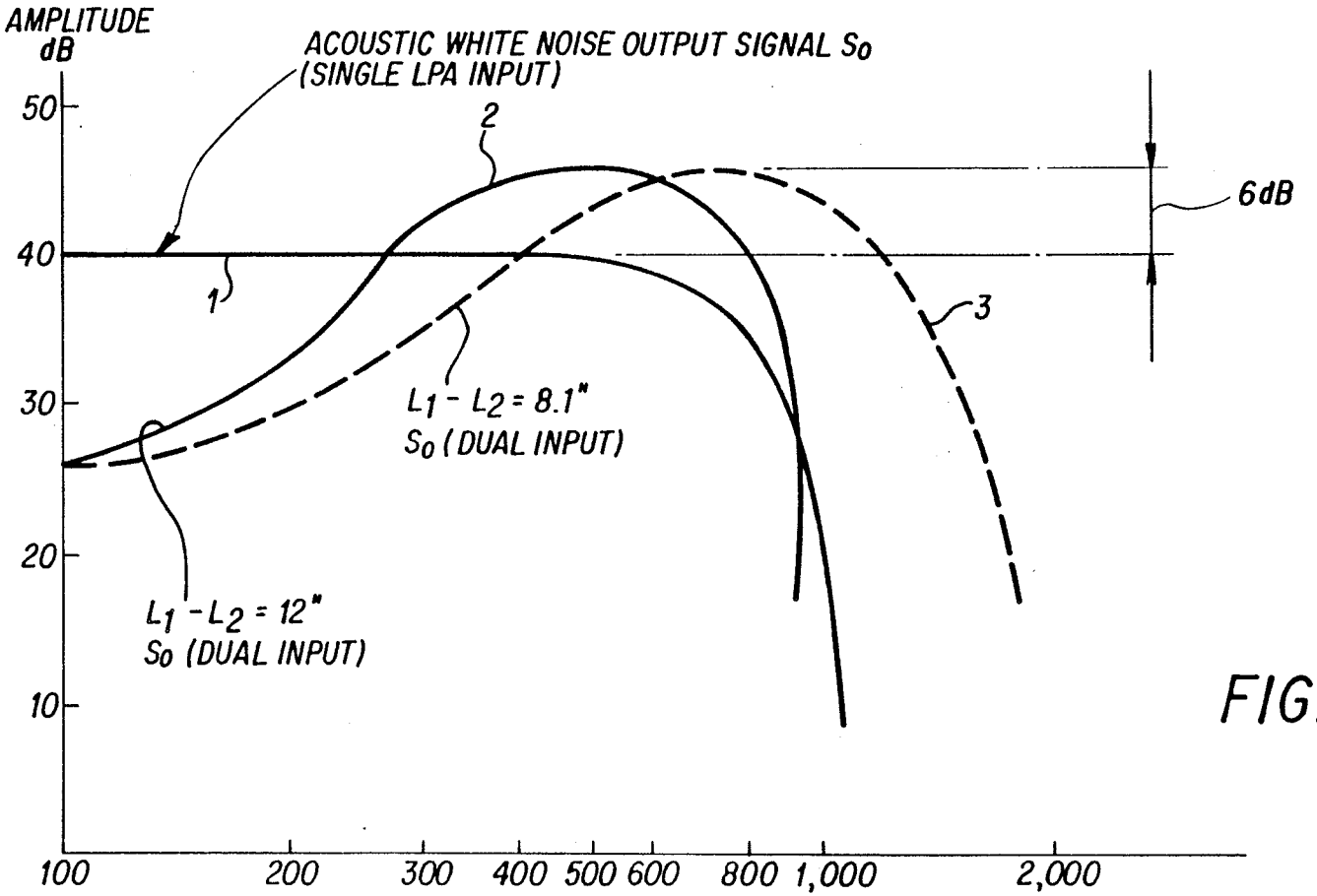
FIG. 1 is a graph of the frequency response of a typical LPA when using single and dual inputs.

For any given acoustic sensing device, if the difference in signal path lengths $L_1-L_2$ is a fixed amount, then the frequency response of the output signal $S_0$ is a shown in FIG. 1. Curve 2 shows the frequency response of a typical LPA when the difference in signal path length $L_1-L_2$ is 12 inches; below 270 Hz, the output signal $S_0$ is attenuated down to a minimum of 26 dB (no gain), at 270 Hz, the output signal $S_0$ is 40 dB (same gain as a single LPA input of of curve 1), at 540 Hz the output signal $S_0$ is 46 dB (gain is doubled over the single LPA input gain) and at 810 Hz, the output signal $S_0$ is 40 dB (same gain as single LPA input). As the difference between signal path lengths $L_1-L_2$ is decreased below 12 inches, curve 2 will shift to the right allowing the LPA to be "tuned" to a selected frequency. For example, curve 3 shows an LPA tuned to 800 Hz by providing a difference in signal path lengths ($L_1-L_2$) of 8.1 inches. This curve shows that a total gain of 46 dB is achieved at 800 Hz, 40 dB, at 400 Hz and 1200 Hz, and almost no gain below 200 Hz.

To those skilled in the art, many modifications and variations of the present invention are possible in light of the above teachings. It is therefore to be understood that the present invention can be practiced otherwise than as specifically described herein and still will be within the spirit and scope of the appended claims.

I claim:

1. A method for adjustment of low frequency acoustic sound in an acoustic detector comprising the steps of:

collecting incoming sound waves in the frequency range of DC to 3000 Hz so as to provide an incoming signal $S_I$;

splitting said incoming signal into two signals $S_1$ and $S_2$ such that signal $S_1$ travels through a first acoustic transmission means a distance of $L_1$ to a first control port of a fluidic laminar proportional amplifier and signal $S_2$ travels through a second acoustic transmission means a distance of $L_2$ to a second control port of said fluidic laminar proportional amplifier;

adjusting said $L_1$ distance such that the phase of input signal $S_1$ is shifted in relation to the phase of input singal $S_2$ when said input signals $S_1$ and $S_2$ arrive at said control ports of said laminar proportional amplifier.

2. The method of claim 1 wherein said phase of input signal $S_1$ is shifted between 0° and 90°.

3. The method of claim 1 wherein said phase of input signal $S_1$ is shifted between 270° and 360°.

4. The method of claim 1 wherein said distance $L_1$ differs from said distance $L_2$ by 12 inches.

5. The method of claim 1 wherein said distance $L_1$ differs from said distance $L_2$ by 8.1 inches.

6. The method of claim 1 wherein said phase of input signal $S_1$ is shifted between 90° and 270°.

7. A method for the cancellation of wind-effect on a fluidic acoustic amplifier comprising the steps of:

collecting incoming sound waves in the frequency range of DC to 3000 Hz so as to provide an incoming signal $S_I$;

splitting said incoming signal into two signals $S_1$ and $S_2$ such that signal $S_1$ travels through a first acoustic transmission means a distance of $L_1$ to a first control port of a C-format fluidic laminar proportional amplifier and signal $S_2$ travels through a second acoustic transmission means a distance of $L_2$ to a second control port of said C-format fluidic laminar proportional amplifier;

adjusting said $L_1$ distance such that the phase of input signal $S_1$ is shifted in the range of 0° to 90° in relation to the phase of input signal $S_2$ when said input signals $S_1$ and $S_2$ arrive at said control ports of said laminar proportional amplifier.

8. A method for the cancellation of wind-effect on a fluidic acoustic amplifier comprising the steps of:

collecting incoming sound waves in the frequency range of DC to 3000 Hz as to provide an incoming signal $S_I$;

splitting said incoming signal into two signals $S_1$ and $S_2$ such that signal $S_1$ travels through a first acoustic transmission means a distance of $L_1$ to a first control port of a C-format fluidic laminar proportional amplifier and signal $S_2$ travels through a second acoustic transmission means a distance of $L_2$ to a second control port of said C-format fluidic laminar proportional amplifier;

adjusting said $L_1$ distance such that the phase of input signal $S_1$ is shifted in the range of 270° to 360° in relation to the phase of input signal $S_2$ when said input signals $S_1$ and $S_2$ arrive at said control ports of said laminar proportional amplifier.

* * * * *